US006543171B2

(12) United States Patent
Kellerman

(10) Patent No.: US 6,543,171 B2
(45) Date of Patent: Apr. 8, 2003

(54) FIREARM BARREL LOCK

(76) Inventor: Donald R. Kellerman, 815 Hwy. P, O'Fallon, MO (US) 63366

( * ) Notice: Subject to any disclaimer, the term of this patent is extended or adjusted under 35 U.S.C. 154(b) by 0 days.

(21) Appl. No.: 10/121,769

(22) Filed: Apr. 12, 2002

(65) Prior Publication Data

US 2002/0121039 A1 Sep. 5, 2002

Related U.S. Application Data

(63) Continuation-in-part of application No. 09/681,198, filed on Feb. 19, 2001, now Pat. No. 6,442,881.

(51) Int. Cl.[7] ..... F41A 17/04; F41A 17/44
(52) U.S. Cl. ..... 42/70.11
(58) Field of Search ..... 42/70.01, 70.11

(56) References Cited

U.S. PATENT DOCUMENTS

| | | | | |
|---|---|---|---|---|
| 2,327,334 A | | 8/1943 | Parker | |
| 2,479,107 A | | 8/1949 | Garretson | |
| 2,763,081 A | | 9/1956 | Huckabee | |
| 2,887,807 A | | 5/1959 | Santangelo | |
| 3,022,598 A | | 2/1962 | Wikstrom | |
| 3,137,957 A | | 6/1964 | Ingalls | |
| 3,564,746 A | | 2/1971 | McConnell | |
| 3,708,901 A | | 1/1973 | Wolter | |
| 3,710,490 A | | 1/1973 | Cornett et al. | |
| 3,720,014 A | | 3/1973 | Goodrich | |
| 4,136,476 A | | 1/1979 | Hetrick | |
| 4,224,753 A | | 9/1980 | Bielman | |
| 4,398,366 A | | 8/1983 | Wernicki | |
| 4,479,320 A | | 10/1984 | Fix | |
| 5,001,854 A | | 3/1991 | Derman | |
| 5,038,508 A | | 8/1991 | Brown | |
| 5,062,233 A | | 11/1991 | Brown | |
| 5,233,777 A | | 8/1993 | Waterman, Jr. et al. | |
| 5,435,090 A | * | 7/1995 | Darrow | 42/95 |
| 6,442,881 B1 | * | 9/2002 | Kellerman | 42/70.11 |

FOREIGN PATENT DOCUMENTS

| | | |
|---|---|---|
| GB | 2233075 | 1/1991 |
| WO | 8806264 | 8/1988 |
| WO | 9206345 | 4/1992 |

OTHER PUBLICATIONS

"Top Security" Gun Lock—5 pages of product photographs. (See description above.) No date.
"Tristar Accessories—Cleaning Kits and Gun Locks" http://www.tristarsportingarms.com/cleankitsgunlocks.htm#gunlocks, 2 pages. No date.
"Tristar Sporting Arms, LTD" http://tristarsportingarms.com/about.htm No date.

* cited by examiner

*Primary Examiner*—Stephen M. Johnson
(74) *Attorney, Agent, or Firm*—Polster, Lieder, Woodruff & Lucchesi L.C.

(57) ABSTRACT

A firearm safety lock comprises a chamber insert and a muzzle insert secured together through the barrel of a firearm by an swiveling adjustable-length cable connection. The chamber insert is sized to fit within the breech of a firearm, and to prevent the loading of ammunition therein. The chamber insert receives a first end of a flexible cable, which is secured to the chamber insert by a swivel connection. The flexible cable extends the length of the firearm barrel, and is fitted, at the opposite end, to a lock receiving rod. The lock receiving rod includes at least one circumferential groove, and passes through an axial bore in the muzzle insert. The flexible cable length is adjusted such that a portion of the lock receiving rod is retained within the barrel, and a portion extends external thereto. A lock element is engaged with the circumferential groove of the lock receiving rod within the axial bore of the muzzle insert, securing the lock receiving rod in swiveling engagement within the muzzle insert, securing the muzzle insert to the lock receiving rod and the chamber insert within the firing chamber, preventing the loading or firing of ammunition from the firearm.

14 Claims, 7 Drawing Sheets

FIREARM BARREL LOCK

CROSS-REFERENCE TO RELATED APPLICATIONS

This application is a continuation-in-part of co-pending U.S. patent application Ser. No. 09/681,198, filed on Feb. 19, 2001, from which priority is claimed.

STATEMENT REGARDING FEDERALLY SPONSORED RESEARCH

Not Applicable.

BACKGROUND OF THE INVENTION

The present invention related to a firearm safety locking apparatus, and more particularly, to a firearm safety lock employing a chamber insert connected to a muzzle insert which is locked against the exterior surface of the muzzle, thereby preventing the loading of ammunition and subsequent firing of a locked firearm such as a rifle, shotgun, or non-revolver type handgun.

Increased awareness of firearm safety has resulted in the desirability of providing a convenient locking mechanism for firearms, particularly for use during storage in a home where children are present, or during vehicular transportation, as may be required by law. Commonly, a conventional trigger locking mechanisms may be employed to block movement of the firearm trigger mechanism. However, trigger locking mechanisms do not prevent the loading of ammunition into the firing chamber of the firearm, and therefore may not prevent a accidental discharge if the trigger lock is dislodged, or incorrectly installed so as to permit sufficient trigger motion to discharge the firearm.

An alternative firearm locking mechanism, of the type shown in U.S. Pat. No. 5,233,777 to Waterman, Jr. et al. employs a cable which extends from a chamber insert, through a muzzle cap, and is secured to an external lock. The cable firearm locking mechanism disclosed in the '777 Waterman, Jr. et al. patent is adjustable to a variety of firearms only by interchanging differently sized and shaped chamber inserts, and by providing cables of differing lengths. However, the firearm locking mechanism shown in the '777 Waterman, Jr. et al. patent may leave a portion of the cable exposed beyond the muzzle cap if the firearm barrel length is shorter than the cable length, as the muzzle cap is not secured against movement relative to the cable. Such an exposed portion of cable may be easily broken or cut using tools commonly found in a typical household to remove the safety lock.

Accordingly, there is a need for a firearm safety lock which is highly visible, prevents the loading of ammunition into the firearm, is adjustable to provide a high degree of security to a wide variety of firearms including rifles, shotguns, and non-revolver type handguns, and which is tamper resistant to a wide variety of hand and power tools commonly found in a typical household.

BRIEF SUMMARY OF THE INVENTION

Briefly stated, the firearm safety lock of the present invention comprises a chamber insert and a muzzle insert secured together through the barrel of a firearm by means of an adjustable-length cable connection. The chamber insert is sized to fit within the breech of a firearm, and to prevent the loading of ammunition therein. A central bore in the chamber insert receives a first end of a flexible cable, which is secured within the central bore. The overall length of the firearm safety lock may be adjusted by repositioning the attachment of the first end of the flexible cable within the chamber insert central bore. The flexible cable extends the length of the firearm barrel, and is fitted, at the opposite end, to a cylindrical lock receiving rod. The lock receiving rod includes at least one circumferential groove, and passes through a central bore in the muzzle insert. The flexible cable length is adjusted to remove any slack such that a portion of the lock receiving rod is retained within the barrel, and a portion of the rod extends external thereto. An off-axis transverse bore in the muzzle insert is aligned with a circumferential groove in the lock receiving rod, permitting an armature of a conventional padlock to pass there through, engaging both the muzzle insert and the lock receiving rod, securing the components against movement.

In an alternate embodiment, a posterior portion of the chamber insert adjacent the firing pin for the firearm contains a recession filled with a pliable material, permitting the firing pin or hammer to be released, or dry fired, thereby removing tension from the firing mechanism springs during storage of the firearm.

In an alternate embodiment, the first end of the flexible cable is fitted to a second locking rod having at least one circumferential groove. The second locking rod is sized to fit fully within the central bore of the chamber insert. The chamber insert includes at least one off-axis transverse bore intersection a portion of the chamber insert central bore, such that a removable lock pin passing through the off-axis transverse bore engages the circumferential groove of the second locking rod within the chamber insert central bore, thereby securing the flexible cable thereto. The overall length of the firearm safety lock may be adjusted by removing the lock pin, repositioning the second locking rod within the central bore of the chamber insert, and inserting the lock pin back into either the same off-axis transverse bore to engage a different circumferential groove in the second locking rod, or into a different transverse bore to engage either the same or a different circumferential groove in the second locking rod.

In an alternative embodiment, the firearm safety lock of the present invention for use with a firearm having a muzzle disposed between a breech and an open end, comprises a cable having opposed first and second ends. A chamber insert sized to fit within a breech of the firearm is secured to the first end of the cable by a swivel connection, while a rigid locking rod is fixed at the second end of said cable. The rigid locking rod includes at least one circumferential groove. A muzzle insert having an axial bore configured to receive the rigid locking rod includes a first portion sized to seat within an open end of the firearm muzzle opposite the chamber insert, and a second portion sized to extend beyond said open end of said firearm muzzle. The second portion has an external diameter greater than an internal diameter of the muzzle. A lock element is configured to removably engage the circumferential groove of said rigid locking rod within the axial bore of the muzzle insert, securing the rigid locking rod in swiveling engagement with the muzzle insert such that the cable is secured through the firearm muzzle between the chamber insert and the muzzle insert, preventing the loading or discharging of the firearm.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

The term barrel as used herein means the tube of a firearm through which a projectile is discharged.

The term muzzle as used herein means the open end of a firearm barrel through which the projectile emerges. The muzzle of a firearm is at the opposite end of the firearm barrel from the chamber or breach, in which the projectile is loaded.

Figure 1:
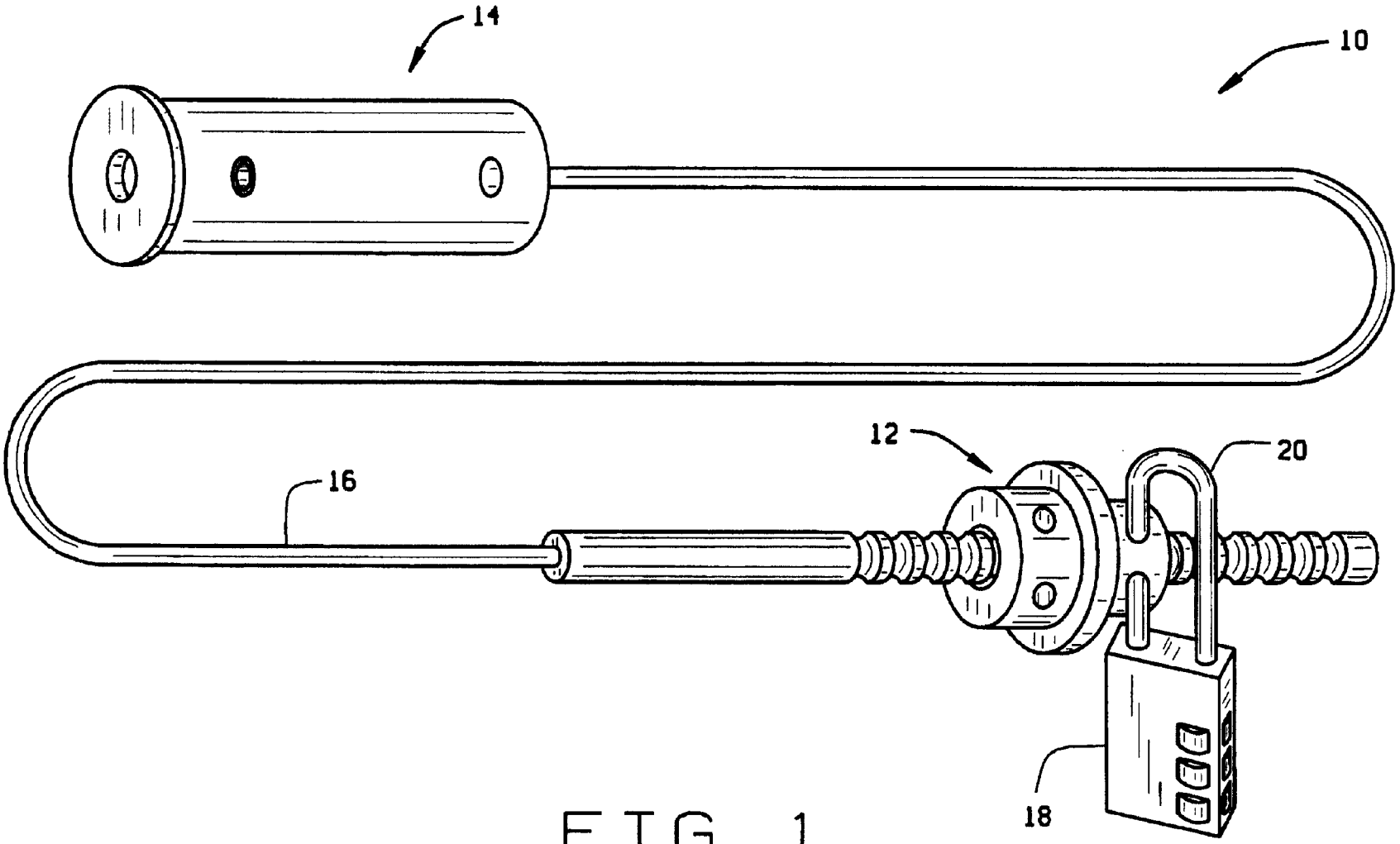
FIG. 1 is a perspective view of an assembled firearm safety lock of the present invention.

Turning to FIG. 1, the components of a first embodiment of the firearm safety locking kit 10 of the present invention are shown assembled external to a firearm. The firearm safety locking kit 10 comprises a muzzle insert 12, a chamber insert or cartridge-style insert 14, a length of connecting cable or tensioning member 16, and a conventional lock 18 having an armature 20. The firearm safety locking kit 10 is especially adapted for use in connection with a wide range of firearm makes and models, including rifles, shotguns, and non-revolver type handguns and may be adjusted to compensate for variations in firearm muzzle or barrel dimensions.

Figure 2:
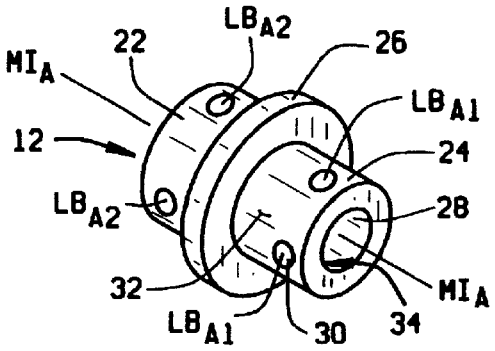
FIG. 2 is a perspective view of a muzzle insert of the present invention.
Figure 3:
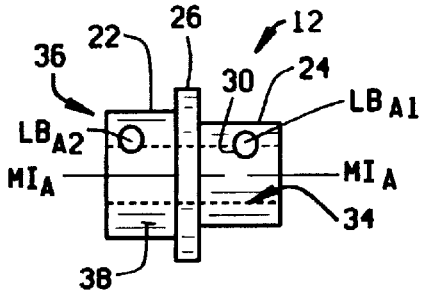
FIG. 3 is a side view of the muzzle insert of FIG. 2.
Figure 4:
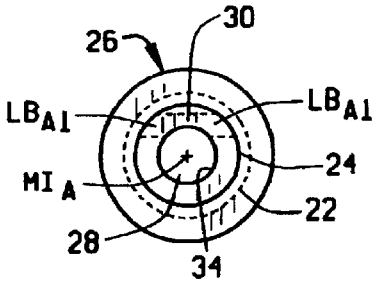
FIG. 4 is an end-view of the muzzle insert of FIG. 2.

Turning to FIGS. 2–4, a first embodiment of the muzzle insert 12 is illustrated. The muzzle insert 12 comprises a first cylindrical portion 22, sized to fit within the muzzle of a conventional firearm barrel of a first caliber. A second cylindrical portion 24, optionally sized to fit with the muzzle of a conventional firearm barrel of a second caliber, is formed axially opposite the first cylindrical portion 22, defining a longitudinal axis $MI_A$. The first and second cylindrical portions 22 and 24 are separated by a circumferential flange or shoulder 26 having a diameter greater than that of either cylindrical portions. When either cylindrical portion 22 or 24 is seated within the muzzle of a firearm, the circumferential flange 26 engages the face of the muzzle, and prevents the muzzle insert 12 from passing through the muzzle. The muzzle insert 12 further includes a longitudinal axial bore 28 sized to receive the connecting cable 16.

An off-axis transverse lock receiving bore 30 formed in the muzzle insert 12 is sized to receive the armature 20 of the lock 18 in the second cylindrical portion 24, perpendicular to the longitudinal axis bore 28. The off-axis transverse lock receiving bore 30 forms a chord between two points on the exterior surface 32 of the second cylindrical portion 24, and intersects the longitudinal axial bore 28 such that the axis $LB_{A1}$ of the off-axis transverse lock receiving bore 30 is tangent to the inner surface 34 of the longitudinal axial bore 28. Optionally, a plurality of off-axis transverse lock receiving bores may be longitudinally spaced along the second cylindrical portion 24.

In a first alternative embodiment, the second cylindrical portion 24 of the muzzle insert 12 is sized to fit with the barrel of a conventional firearm of a second caliber, and the first cylindrical portion 22 further includes a second off-axis transverse lock receiving bore 36, similarly sized to receive the armature 20 of lock 18. The second off-axis transverse lock receiving bore 36 forms a chord between two points on the exterior surface 38 of the first cylindrical portion 22, and intersects the longitudinal axial bore 28 such that the axis $LB_{A2}$ of the off-axis transverse lock receiving bore 36 is tangent to the inner surface 34 of the longitudinal axial bore 28. Optionally, a plurality of second off-axis transverse lock receiving bores may be longitudinally spaced along the first cylindrical portion 22.

Figure 6:
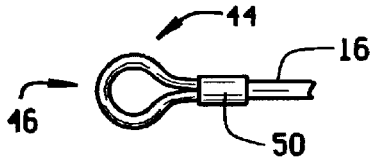
FIG. 6 is a view of the second end of the cable of FIG. 5, illustrating a crimped loop.
Figure 5:
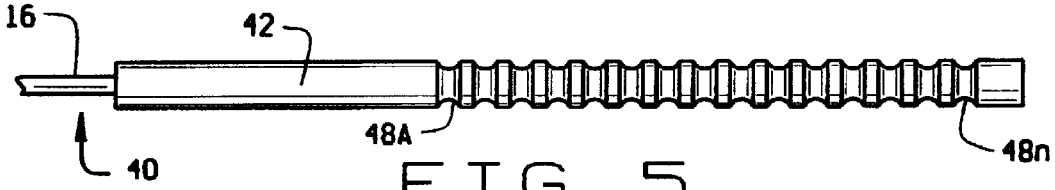
FIG. 5 is a side view of a first cylindrical locking rod of the present invention affixed to a first end of a cable.

Turning next to FIGS. 5 and 6, the connecting cable or tensioning member 16 is shown in one embodiment with a first end 40 secured to a cylindrical locking rod 42, and a second end 44 formed into a crimped loop 46. The connecting cable 16 is preferably formed from a conventional multi-strand stainless steel wire of sufficient strength to resist breakage and cutting, but may optionally be formed from other materials, including single-strand wire or polymer materials having suitable properties. A protective sleeve (not shown) may optionally be fitted about the cable adjacent each end to resist excessive bending or cutting of the cable. The first end 40 of the connecting cable is secured to the base of the cylindrical locking rod 42. The cylindrical locking rod 42 is formed from a rigid material, preferably hardened or treated steel, has an out diameter sized to fit within the longitudinal axis bore 28 of the muzzle insert 12, and includes at least one circumferential groove 48*a*.

The circumferential groove 48*a* presents a hemispherical cross-section, and has the same radius as the off-axis transverse lock receiving bore 30. Optionally, a plurality of identically formed and equidistantly spaced circumferential grooves 48*a*–48*n*, where "n" is intended to designate any suitable number, depending upon the length of the rod 42, may be spaced longitudinally about the cylindrical locking rod 42. The longitudinal length of the cylindrical locking rod 42 is preferably between 3.0 and 5.0 inches, with a total of 15 circumferential grooves 48*a*. Those of ordinary skill in the art will recognized that the specific dimensions of the cylindrical locking rod 42, and the number "n" and spacing of the circumferential grooves 48*a* may be varied, depending upon the type and dimensions of the firearm for which the firearm safety lock kit 10 is configured for use.

As seen in FIG. 6, the second end 44 of the connecting cable 16 is formed into a conventional crimped loop 46. The crimped loop 46 may be formed by crimping the second end 44 of the connecting cable 16 in parallel with itself using a conventional metal crimp 50, or in the second end 44 may be woven back into the connecting cable 16, forming an integral loop (not shown). Those of ordinary skill in art will recognize that a variety of loops and crimps may be formed at the second end 44 of the connecting cable 16, including, but not limited to, the attachment of the connecting cable to a preformed metal hoop, or an integrally formed opening in a polymer cable.

Figure 7:
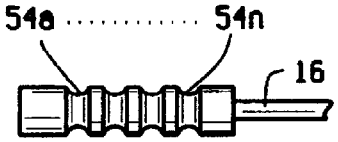
FIG. 7 is an view of an alternate embodiment of the second end of the cable of FIG. 5, illustrating a second cylindrical locking rod.

In an alternative embodiment shown in FIG. 7, the second end 44 of the connecting cable 16 is secured to the base of a second cylindrical locking rod 52. The second locking rod 52 is formed from a rigid material, preferably hardened or treated steel, has an out diameter sized to engage the chamber insert 14, as will be described below in more detail, and includes at least one circumferential groove 54*a*.

The circumferential groove 54*a* is formed to the same dimensions as the circumferential groove 48*a* in the first cylindrical locking rod 42. Optionally, a plurality of identically formed and equidistantly spaced circumferential grooves 54*a*–54*n* where "n" is intended to designate any suitable number, depending upon the length of the rod 52, may be spaced longitudinally about the second locking rod 52. The longitudinal length of the second locking rod 52 is sized to fit within the chamber insert 14, as will be described below in more detail. Those of ordinary skill in the art will recognized that the specific dimensions of the second locking rod 52, and the number "n" and spacing of the circumferential grooves 54*a* may be varied, depending upon the type and dimensions of the firearm for which the firearm safety lock kit 10 is configured for use, as the dimensions of the chamber insert 14 will so vary.

Figure 8:
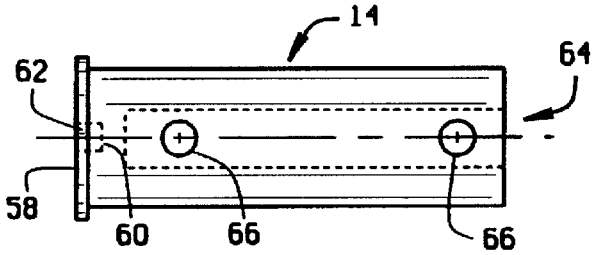
FIG. 8 is a side view of a chamber insert for use with the crimped look of FIG. 6.
Figure 9:
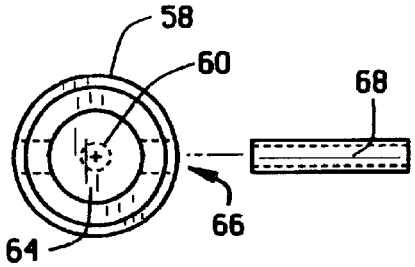
FIG. 9 is an end view of the chamber insert of FIG. 8, illustrating the placement of a locking pin.
Figure 11B:
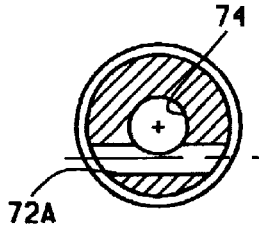
FIG. 11B is a first section view of the chamber insert of FIG. 11A, illustrating the off-axis transverse bore and longitudinal bore relationships.

Turning next to FIG. 8 through FIG. 10, a first embodiment of the chamber insert 14 configured for use with the connecting cable 16 having a second end 44 forming a loop 46, as seen in FIG. 6, is shown. The chamber insert 14 has external dimensions corresponding to the dimensions of the ammunition utilized by the type of firearm for which the firearm safety lock kit 10 of the present invention is to be utilized. For example, as shown in FIG. 8, the chamber insert has external dimensions corresponding to a conventional 12-gauge shotgun shell, for use with conventional 12-gauge shotguns.

At the base 58 of the chamber insert 14, and axial recess 60 is filled with a resilient material 62, such as natural or synthetic rubber, and is positioned to receive a firing pin or hammer from a firearm when the chamber insert is placed within the breech of the firearm. In this manner, the firing mechanism of the firearm may be released, or "dry-fired", from any spring-loaded tension, permitting long-term storage thereof.

Opposite the base 58, a longitudinal axial bore 64 extends partially through the chamber insert 14, and is intersected by at least one transverse lock pin receiving bore 66. Each lock pin receiving bore 66 is configured to removably receive a lock pin 68. The lock pin 68 may be seated within the receiving bore 66 either by friction fit, or engaging threads (not shown).

Figure 10A:
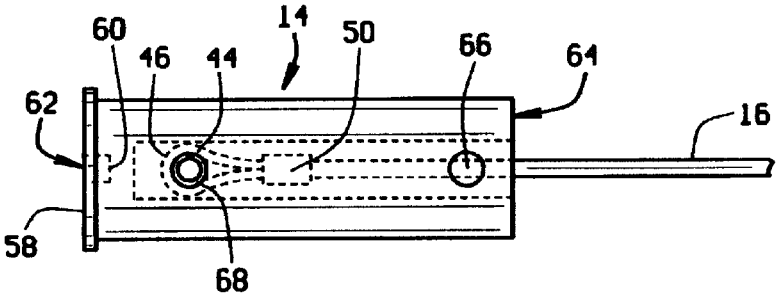
FIG. 10A is a view of the crimped cable loop of FIG. 6 secured in a first position in the chamber insert of FIG. 8.
Figure 11C:
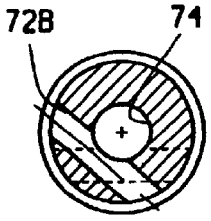
FIG. 11C is a second section view of the chamber inset of FIG. 11A, illustrating the relationship between two of the off-axis transverse bores and the longitudinal bore.
Figure 10B:
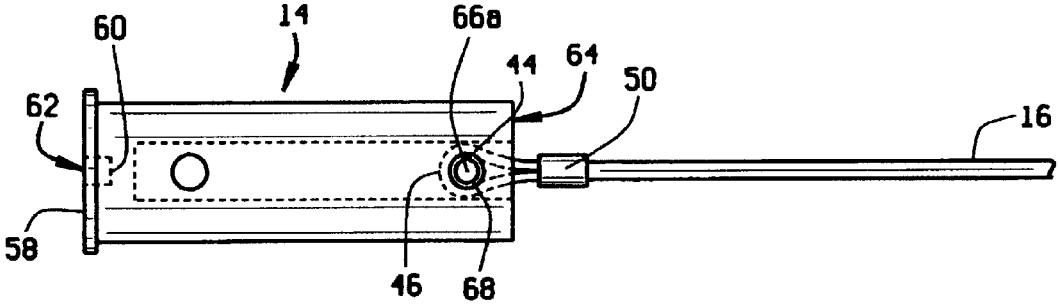
FIG. 10B is a view of the crimped cable loop of FIG. 6 secured in a second position in the chamber insert of FIG. 8.
Figure 11A:
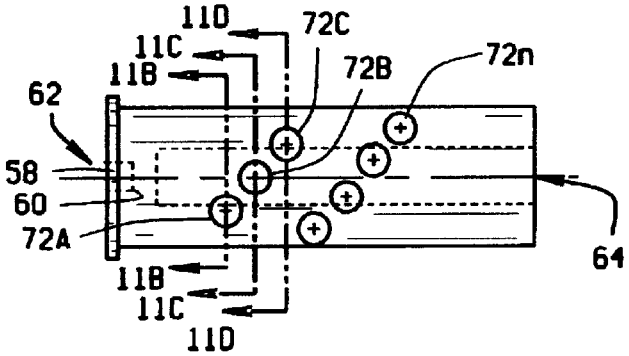
FIG. 11A is a side view of an alternate embodiment of the chamber insert for use with the second cylindrical locking rod of FIG. 7.
Figure 11D:
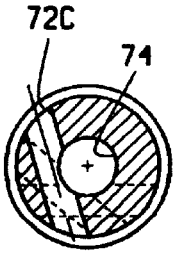
FIG. 11D a third section view of the chamber insert of FIG. 11A, illustrating the relationship between three of the off-axis transverse bores and the longitudinal bore.

To secure the connecting cable 16 to the chamber insert 14, the loop 46 at the second end of the connecting cable 16 is inserted into the longitudinal axial bore 64 opposite the base 58. The loop 46 is positioned coaxially with the lock pin receiving bore 66, and the lock pin 68 inserted therein, as seen in FIG. 10A. The lock pin 68 passes through the coaxially positioned loop 46, and removably secures the connecting cable 16 to the chamber insert 14. In an alternative embodiment, a plurality of lock pin receiving bores 66–66*n*, where "n" is intended to designate any suitable number of bores, depending upon the length of the chamber insert 14, are formed in the chamber insert 14 at different longitudinal positions (FIG. 10B) along the axial bore 64, permitting the connecting cable 16 to be secured to the chamber insert 14 at different longitudinal positions, thereby adjusting the overall length of the firearm safety lock 10.

Turning next to FIG. 11A through FIG. 12B, an alternate embodiment of the chamber insert 14 configured for use with the connecting cable 16 having a second end 44 secured to the base of a second cylindrical locking rod 52, as seen in FIG. 7, is shown. Opposite the base 58, a reduced diameter axial bore 70 in the chamber insert 14 is sized axially and longitudinally to receive the length of the second cylindrical locking rod 52. The axial bore 70 is tangentially intersected by at least one off-axis transverse lock-pin bore 72*a*. As is seen in FIG. 11B, the longitudinal axis of the off-axis transverse lock-pin bore 72*a* is tangential to the inner surface 74 of the axial bore 70, such that the bores 70 and 72*a* intersect. In a second alternate embodiment, a plurality of off-axis transverse lock-pin bores 72*a*–72*n*, where "n" is intended to designate any suitable number of bores, depending upon the length of the chamber insert 14, are longitudinally spaced along the length of the chamber insert 14 axial bore 70. As is seen in FIGS. 11A–11D, the lock-pin bores 72*a*–72*c* may be spaced about the axial bore 70 in a spiral pattern, or other suitable pattern as is evident to those of ordinary skill in the art.

Figure 12B:
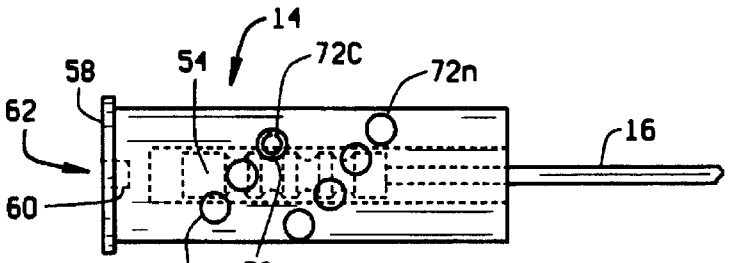
FIG. 12B is a view of the second locking rod of FIG. 7 secured in a second position in the chamber insert of FIG. 11A.
Figure 12A:
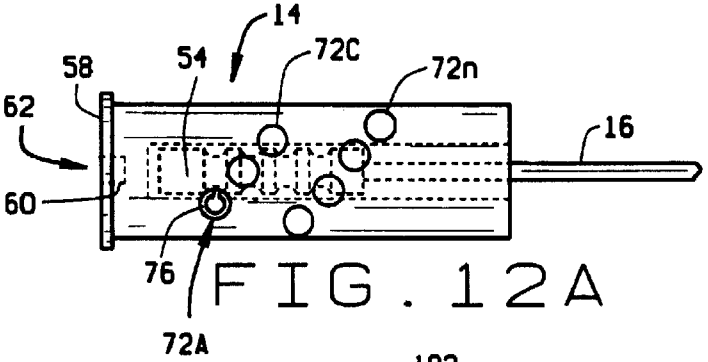
FIG. 12A is a view of the second locking rod of FIG. 7 secured in a first position in the chamber insert of FIG. 11A.

As seen in FIGS. 12A and 12B, to secure the connecting cable 16 to the chamber insert 14, the second cylindrical locking rod 52 is inserted into the axial bore 70 of the chamber insert, and a lock-pin 76 is driven through the off-axis transverse lock-pin bore 72*a*, engaging both the chamber insert 14 and the circumferential groove 54 in the locking rod 52. In this manner, the locking rod 52 is removably secured within chamber insert 14 by the lock-pin 76. In the alternate embodiments described above, the lock-pin 76 may be inserted in one of the lock pin bores 72*a*–72*n*, to engage the circumferential groove 54 at a different longitudinal position within the axial bore 70 of the chamber insert, thereby altering the overall length of the firearm safety lock 10, as is shown in FIG. 12B. Those of ordinary skill in the art will recognize that the overall length of the firearm safety lock 10 may be adjusted to a variety of lengths depending upon the number and placement of the lock-pin bores 72*a*–72*n* in the chamber insert 14, and upon the number and placement of the circumferential grooves 54 in the locking rod 52. Engagement of the lock-pin 76 with alternate circumferential grooves 54 in alternate lock-pin bores 72*a*–72*n* providing a plurality of overall lengths.

Figure 13:
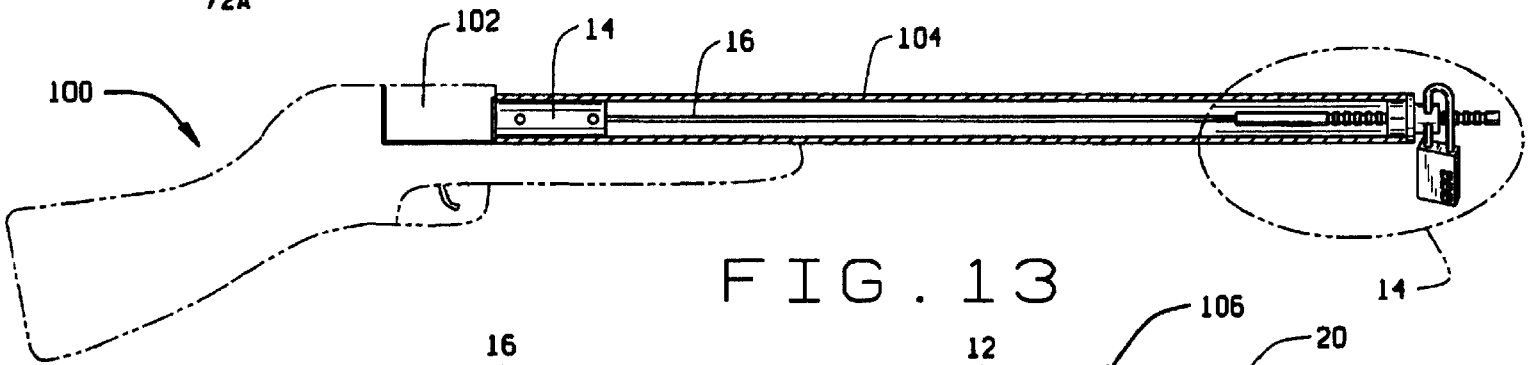
FIG. 13 is cut-away illustration of a conventional firearm with the components of the safety locking kit of the present invention secured therein.
Figure 14:
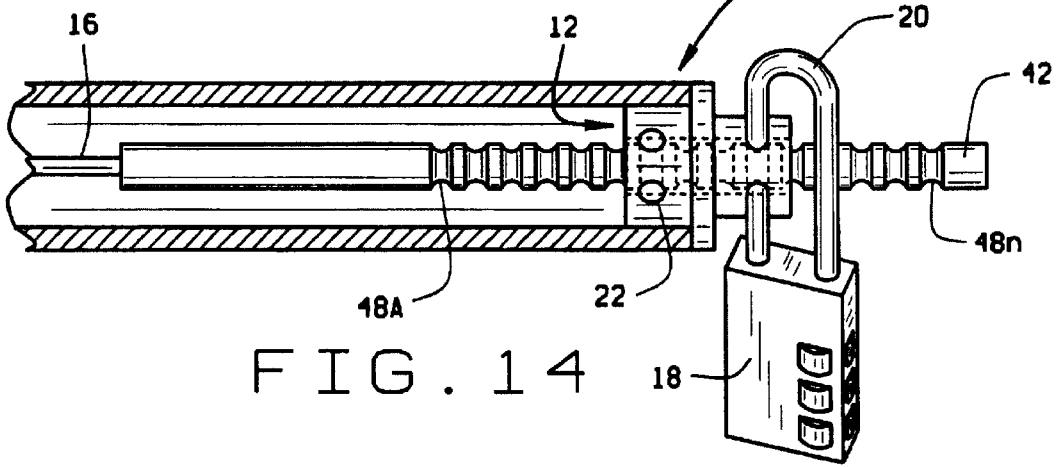
FIG. 14 is a enlargement of the firearm muzzle of FIG. 10, illustrating the securing of the muzzle insert to the first locking rod by the lock armature.
Figure 15A:
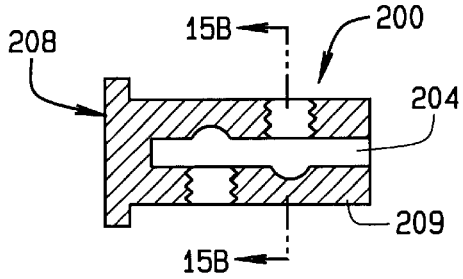
FIG. 15A is a sectional view of a cable attachment swivel component.
Figure 15B:
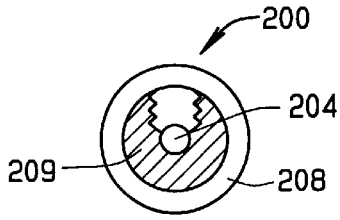
FIG. 15B is a sectional view of the cable attachment swivel component of FIG. 15A, taken along line 15B—15B, illustrating a set screw threaded bore.
Figure 16A:
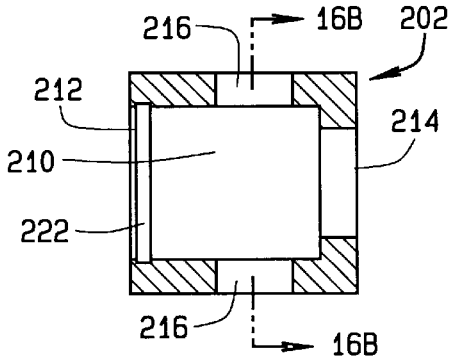
FIG. 16A is a sectional view of a chamber insert swivel component for use with the cable attachment swivel component of FIG. 15A.
Figure 16B:
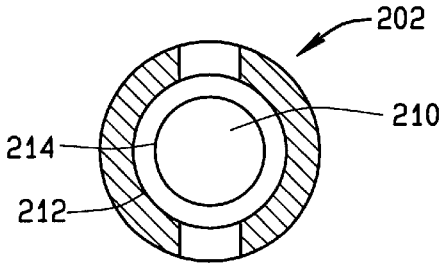
FIG. 16B is a sectional view of the chamber insert swivel component of FIG. 16A, taken along line 16B—16B, illustrating the transverse bores.

Turning next to FIGS. 13 and 14, the use of the firearm safety lock kit 10 is shown. Any conventional firearm 100, for example, a shotgun, having a single accessible breech area 102, a barrel 104, and a muzzle end 106 may be locked using the firearm safety lock kit 10 of the present invention. To lock the firearm 100, a firearm safety lock kit 10 having a chamber insert 14 with dimensions corresponding to the dimensions for the ammunition for the firearm 100 is selected. The connecting cable 16 is secured to the chamber insert 14, and is passed into the barrel 104 through the breech area 102 of the firearm until the chamber insert 14 seats in the breech area 102. Optimally, when the connecting cable 16 is drawn through the barrel 104 under tension, a portion of the cylindrical locking rod 42 and at least one circumferential groove 48 extends beyond the muzzle end 106 of the firearm 100. The firearm safety lock kit 10 may be adjusted at the attachment point between the chamber insert 14 and the connecting cable 16 to adjust the length as is required to achieve the optimal extension of the cylindrical locking rod 42 beyond the muzzle end 106.

Next, the muzzle insert 12 is fitted over the cylindrical locking rod 42, such that the first cylindrical portion 22 seats within the barrel 104 and the circumferential flange 26 engages the muzzle end 106. Optimally, when the circumferential flange 26 engaged the muzzle end 106, the off-axis transverse lock receiving bore 30 in the second cylindrical portion 24 of the muzzle insert 12 is aligned with at least one circumferential groove 48 in the cylindrical locking rod 42. The firearm safety lock kit 10 may be adjusted at the attachment point between the chamber insert 14 and the connecting cable 16 to adjust the length as is required to align the off-axis transverse lock receiving bore 30 with the circumferential groove 48 when the muzzle insert 12 is seated in the muzzle end 106 of the barrel 104.

Optionally, the first cylindrical portion 22 may be slightly withdrawn from the barrel 104 to align the off-axis transverse lock receiving bore 30 with the circumferential groove 48.

Finally, as seen in FIG. 14, the armature 20 of a conventional lock 18 is passed through the off-axis transverse lock receiving bore 30 and returned to the lock 18, engaging the circumferential groove 48 in the cylindrical locking rod 42. The armature 20 prevents longitudinal movement of the muzzle insert 12 relative to the cylindrical locking rod 42. It will also be noted to those of ordinary skill in the art that the circumferential groove 48 into which the armature 20 is engaged will permit the lock 18 to swivel a full 360 degrees of rotation relative to the longitudinal axis of the firearm barrel. Furthermore, swiveling of the lock 18, the muzzle insert 12, or the locking rod 42 will not result in tightening or kink formation in the connecting cable 16, as the cable 16 and chamber insert 14 are both free to rotate about the longitudinal axis of the firearm barrel.

Removal of the firearm safety lock 10 from the firearm 100 is a reverse procedure. First, the conventional lock 18 is opened, then the armature removed from the off-axis transverse lock receiving bore 30, disengaging the muzzle insert 12 from the cylindrical locking rod 42. Once disengaged, the muzzle insert is readily removed from the muzzle end 106 of the firearm 100, and the chamber insert 14 withdrawn from the breech area 102. The connecting cable is pulled back through the firearm barrel 104 as the chamber insert 14 is withdrawn, and the firearm is available for use.

As best seen in FIG. 13, when the firearm safety kit 10 is utilized to lock the firearm 100, removal of the muzzle insert 12 from the muzzle end 106 of the firearm is prevented by the interaction between the armature 20, the cylindrical locking rod 42, the connecting cable 16, and the chamber insert 14, which cannot pass through the firearm barrel 104. Removal of the chamber insert 14 is similarly prevented by the muzzle insert 12. When secured through a firearm barrel 104 by the connecting cable 16, the chamber insert prevents the loading of ammunition into the breech area 102 of firearm 100, thereby precluding discharge thereof. The muzzle insert 12, secured in the muzzle end 106 by the cylindrical locking rod 42 is prevented from axial movement by the armature 20 of the lock 18, thereby preventing access to any portion of the connecting cable 16. Tampering with the exposed portion of the cylindrical locking rod 42 will not release the remaining portion of the locking rod 42 from engagement with the armature 20 within the muzzle insert 12. In this manner, once installed on the firearm 100, the firearm safety locking kit 10 of the present invention effectively prevents the loading and use of the firearm 100.

Figure 17:
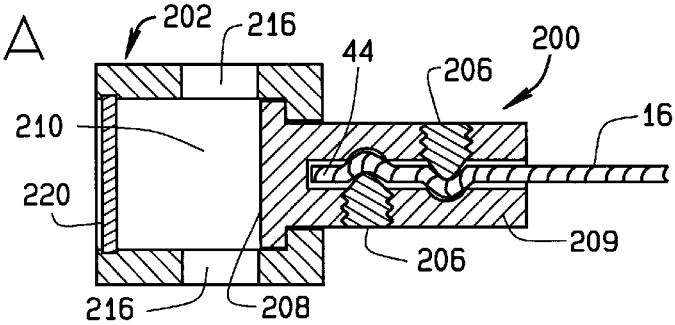
FIG. 17 is a sectional view of the assembled cable attachment and chamber insert swivel components, together with an optional floating end-cap.

Turning to FIGS. 15A through 17, a preferred alternate embodiment of the cable connection for use in connecting the chamber insert 14 to the second end 44 of the connecting cable 16 is shown. The conventional crimped loop 46 shown in FIGS. 10A and 10B does not permit the connecting cable 16 to swivel relative to the chamber insert 14. To facilitate a swivel connection between the chamber insert 14 and the connecting cable 16, a cylindrical plug 200, is utilized, shown in FIGS. 15A and 15B, seated within a cylindrical housing 202, shown in FIGS. 16A and 16B. The second end 44 of the connecting cable 16 is secured within an axial bore 204 of the cylindrical plug 200, preferably using one or more threaded set screws 206 to clamp the connecting cable 16 within the axial bore 202. A protective sleeve (not shown) may be fitted to the cable 16 adjacent the cylindrical plug 200. The cylindrical plug 200 includes a base flange 208 having a greater diameter than the body 209 of the cylindrical plug 200. To provide for swivel movement, the cylindrical plug 200 is seated within the cylindrical housing 202 as seen in FIG. 17.

The cylindrical housing 202 includes an axially disposed bore 210 having first open end 212 with a diameter greater than that of the base flange 206, and a second open end 214 with a diameter less than that of the base flange 206, but greater than that of the cylindrical plug body 209.

As seen in FIG. 17, when the cylindrical plug 200 is seated within the cylindrical housing 202, the body 209 passes through the second open end 214, and the base flange 208 is retained within the axially disposed bore 210. The cylindrical plug 200 and the cylindrical housing 202 freely rotate relative to each other about a common axis.

To secure the connecting cable 16 to the chamber insert 14, a pair of transverse lock pin receiving bores 216 in the cylindrical housing 202 receive a lock pin 68 passing through the transverse lock pin receiving bores 66 in the chamber insert 14, as described above. The cylindrical housing 202 is thereby secured in a fixed relationship within the longitudinal axial bore 64 of the chamber insert 14, while the cylindrical plug and attached connecting cable 16 remain free to swivel or rotate about the common longitudinal axis, preventing binding, tightening or kinking thereof.

Optionally, to secure the cylindrical plug 200 within the cylindrical housing 202 when removed from the chamber insert 14, an closure plate or disc 220 may be seated within a recessed groove or channel 222 adjacent the first open end 212. The closure plate or disc 220 is preferably formed from a hardened metal, and is free to rotate within the recessed groove or channel 222, thereby providing the additional benefit of impeding attempts to drill axially through an exposed end of the chamber insert 14 seated in a firearm breach to release the connecting cable 16 when a firearm is secured by the locking components of the present invention.

Those of ordinary skill in the art will recognize that the present invention may be implemented utilizing a variety of connections to secure the connecting cable 16 to the chamber insert 14 with a swivel connection. It is recognized that the specific type of swivel connection and the manner in which the second end 44 of the connecting cable 14 is secured with the chamber insert 14 may be varied depending upon the particular type of cable selected, and upon the desired strength of the connection. Correspondingly, alternate components, not shown, may be utilized to maintain the cylindrical plug 200 with the cylindrical housing 202, or to impede attempts to axially drill through the chamber insert 14 when it is seated within a firearm breach. For example, the inclusion of one or more freely rotating hardened plates within the longitudinal bore of the chamber insert 14 would impede the progress of a drill bit or similar rotating cutting tool.

Turning next to FIGS. 18A–18D, an alternate embodiment of the muzzle insert of the present invention is shown generally at 300. The muzzle insert 300 comprises a cylindrical portion 302, sized to fit within the muzzle of a conventional firearm barrel of a known caliber. A semi-cylindrical portion 304, having a diameter greater than that of the first cylindrical portion 302 includes a first circumferential flange 306 and a spaced apart second circumferential flange 308, defining a circumferential channel 310 there between. The circumferential channel is sized to receive a curved shackle 314 of a conventional lock 316, such as a padlock or combination-lock. Semi-cylindrical portion 304 preferably includes a chord face 311 at a diameter greater than that of the cylindrical portion 302 defining a flattened surface against which the body of the conventional lock 316 abuts when the shackle 314 is secured within the circumferential channel 310.

Figure 18A:
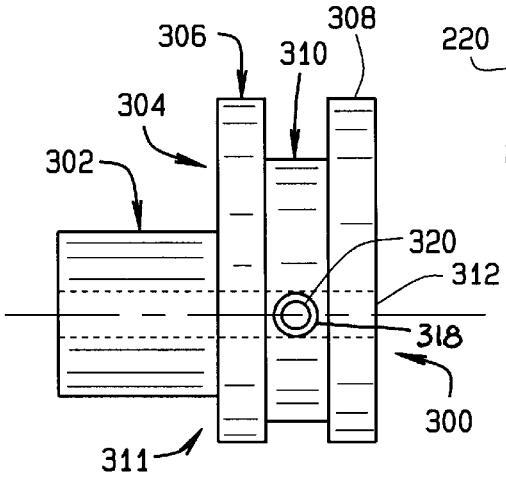
FIG. 18A is a side view of an alternate embodiment muzzle insert of the present invention.
Figure 18B:
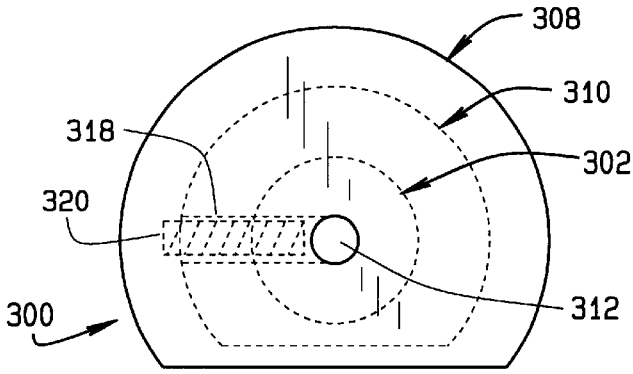
FIG. 18B is an end view of the muzzle insert of FIG. 18A.
Figure 18C:
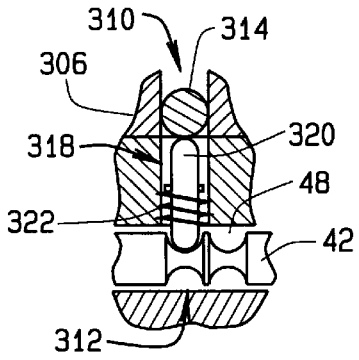
FIG. 18C is an enlarged partial sectional view of a lock pin utilized with the muzzle insert shown in FIG. 18A, in engagement with a rigid locking rod.
Figure 18D:
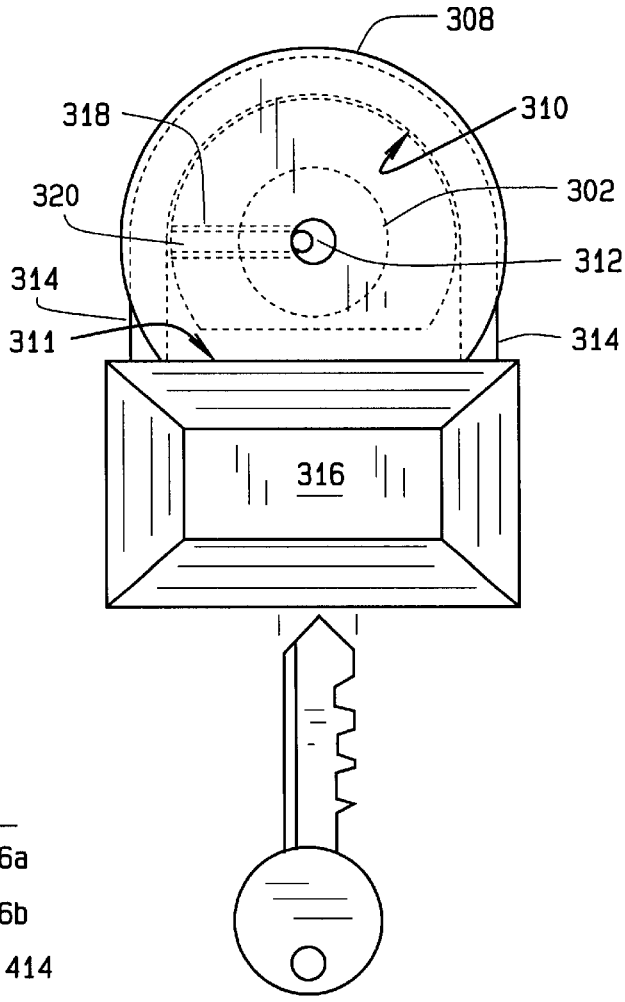
FIG. 18D is an end view of the muzzle insert of FIG. 18A, illustrating placement of a convention padlock.

When the cylindrical portion 302 is seated within the muzzle of a firearm, the semi-cylindrical portion 304 engages the face of the muzzle, and prevents the muzzle insert 300 from passing through the muzzle. The muzzle insert 300 further includes a longitudinal axial bore 312 sized to receive the connecting cable 16 and associated locking rod 42. At least one radial bore 318 extends between the circumferential channel 310 and the axial bore 312. Secured within each radial bore 318 is a displaceable locking pin 320 movable between a unlocked position (FIG. 18B) in which a portion of the locking pin 320 is displaced within the circumferential groove 310 and absent from the axial bore 312, and a locked position (FIG. 18C) in which a portion of the locking pin 320 is displaced within the axial bore 312 and absent from the circumferential channel 310. As seen in FIG. 18C, the locking pin 320 is displaced from the unlocked position to the locked position by the placement of the shackle 314 within the circumferential channel 310. In the locked position, a portion of the locking pin 320 is displaced within the axial bore 312, and seats within a circumferential groove 48 formed in the locking rod 42, securing the locking rod 42 in swiveling engagement within the muzzle insert 300.

Those of ordinary skill in the art will recognize that the locking pin 320 may be configured in a variety of different ways to provide for restrained displacement between the locked and unlocked positions. For example, as is shown in FIG. 18C, the locking pin 320 may be biased by a spring element 322 towards the unlocked position, such that placement of the shackle 314 in the circumferential groove 310 results in the radial movement of the locking pin 320 to the locked position and the compression of the spring element 322. Suitable conventional elements such as ridges or flanges may be utilized to further retain the locking pin 320 within the radial bore 318 without departing from the scope of the invention.

Figure 19A:
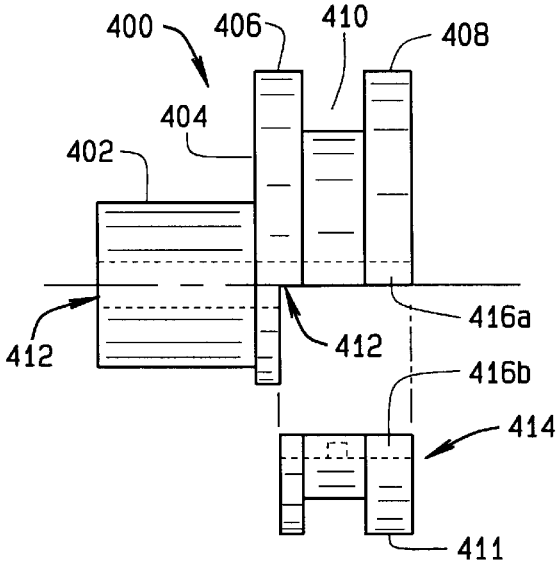
FIG. 19A is a side view of a two-piece alternate embodiment muzzle insert of the present invention.
Figure 19C:
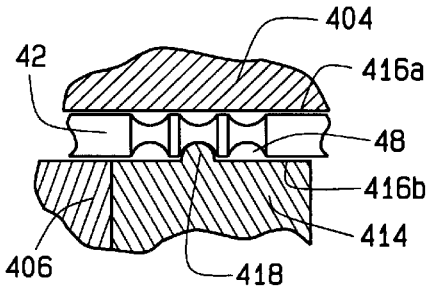
FIG. 19C is an enlarged partial sectional view of a lock element incorporated into the two-piece muzzle insert shown in FIG. 19A, in engagement with a rigid locking rod.
Figure 19D:
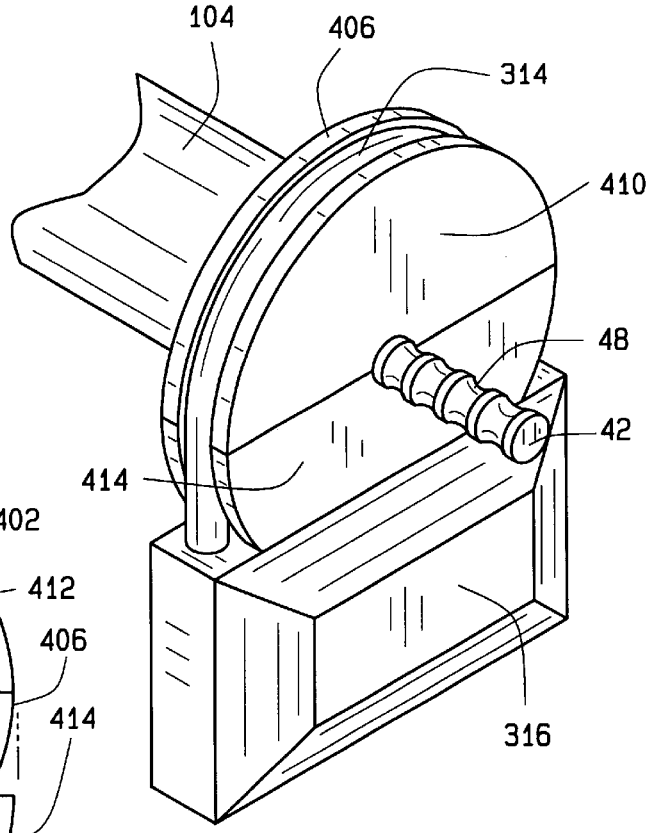
FIG. 19D illustrates a perspective view of the two-piece muzzle insert of FIG. 19A in use in the muzzle of a firearm.
Figure 19B:
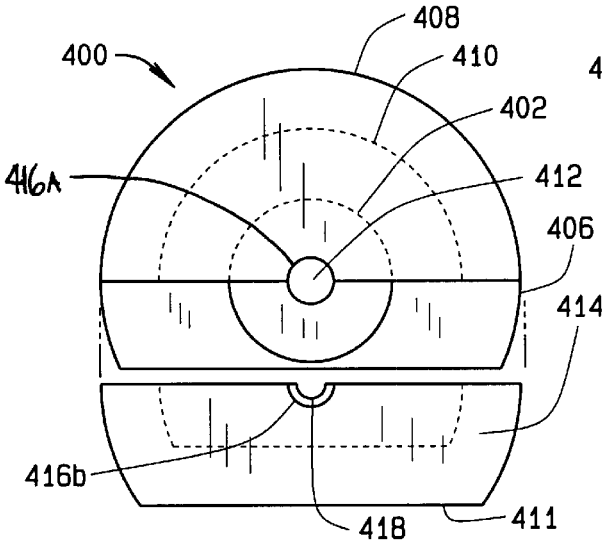
FIG. 19B is an end view of the two-piece muzzle insert of FIG. 19A.

Turning next to FIGS. 19A–19C, an alternate embodiment of the muzzle insert of the present invention is shown generally at 400. The muzzle insert 400 comprises a cylindrical portion 402, sized to fit within the muzzle of a conventional firearm barrel of a known caliber. A semi-cylindrical portion 404, having a diameter greater than that of the first cylindrical portion 402 includes a first circumferential flange 406 and a spaced apart second circumferential flange 408, defining a circumferential channel 410 there between. The circumferential channel 410 is sized to receive a curved shackle 314 of a conventional lock 316, such as a padlock or combination-lock. Semi-cylindrical portion 404 preferably includes a chord face 411 at a diameter greater than that of the cylindrical portion 402 defining a flattened surface against which the body of the conventional lock 316 abuts when the shackle 314 is secured within the circumferential channel 410.

When the cylindrical portion 402 is seated within the muzzle of a firearm, the semi-cylindrical portion 404 engages the face of the muzzle, and prevents the muzzle insert 400 from passing through the muzzle. The muzzle insert 400 further includes a longitudinal axial bore 412 sized to receive the connecting cable 16 and associated locking rod 42, and a removable lock element 414 diametrically bisecting the semi-cylindrical portion 404.

The removable lock element 414 incorporates a portion of the first circumferential flange 406 and the second circumferential flange 408, as well as the chord face 411. The axial bore 412 is diametrically bisected by the removable lock element 414, such that a portion of the axial bore 412 passing through the semi-cylindrical portion 404 is defined by an hemi-cylindrical axial groove 416A in the semi-cylindrical portion 404 and a hemi-cylindrical groove 416B in the removable lock element 414. A radial lock ridge 418 projects radially inward within the hemi-cylindrical groove 416B.

As shown in FIG. 19C, when the removable lock element 414 is seated against the semi-cylindrical portion 404, the hemi-cylindrical axial grooves 416A and 416B cooperate to define an extension of the axial bore 412 through which the connecting cable 16 and associated locking rod 42 are passed.

To secure the locking rod 42 within the muzzle insert 400, the locking rod 42 is positioned such that the radial lock ridge 418 seats within one of the circumferential grooves 48 in the surface of the lock rod 42, providing a swiveling attachment. The removable lock element 414 is then secured in place by the placement of a shackle 314 from a conventional padlock 316 within the circumferential channel 410, and the locking of the conventional padlock 316 against the chord face 411, in the same manner as described above for muzzle insert 300 and shown in FIG. 19D.

Figure 20:
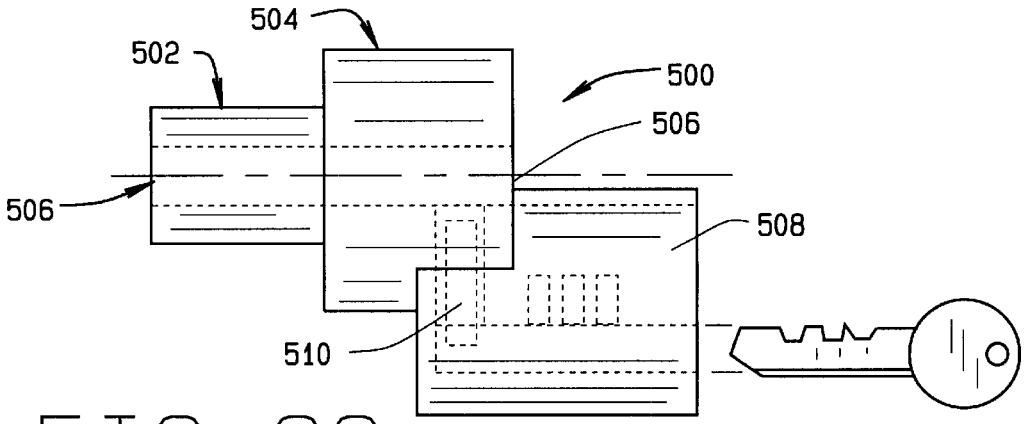
FIG. 20 is a side view of an alternate embodiment muzzle insert of the present invention incorporating a key actuated lock element.

Turning next to FIG. 20, an alternate embodiment of the muzzle insert of the present invention is shown generally at 500. The muzzle insert 500 comprises a first cylindrical portion 502, sized to fit within the muzzle of a conventional firearm barrel of a known caliber. A second cylindrical portion 504, having a diameter greater than that of the first cylindrical portion 502 is axially aligned with the first cylindrical portion 502. When the first cylindrical portion 502 is seated within the muzzle of a firearm, the second cylindrical portion 504 engages the face of the muzzle, and prevents the muzzle insert 500 from passing through the muzzle. The muzzle insert 500 further includes a longitudinal axial bore 506 sized to receive the connecting cable 16 and associated locking rod 42.

To secure the locking rod 42 within the muzzle insert 500, a conventional locking mechanism 508 is affixed to the second cylindrical portion 504 such that a locking element 510 actuated by the locking mechanism 508 is displaced from an unlocked position within the body of the second cylindrical portion 504 to a locked position partially disposed within the axial bore 506. Shown in FIG. 20, a conventional keyed locking mechanism 508 actuates the locking element 510 in a radial direction relative to the axial bore 506.

To secure the locking rod 42 within the muzzle insert 500, the locking rod 42 is positioned such that the locking element 510 displaced to the locked position to seat within one of the circumferential grooves 48 in the surface of the lock rod 42, providing a swiveling attachment between the locking rod 42 and the muzzle insert 500. Those of ordinary skill in the art will recognize that the keyed locking mechanism shown in FIG. 20 may be replaced by combination-type locking mechanism or any other locking mechanism adapted to move a locking element 510 from an unlocked position to a locked position in which one or more of the circumferential grooves 48 of the locking rod 42 are engaged within the axial bore 506 of the muzzle insert 500.

Those of ordinary skill in the art will recognize that the components of the firearm safety lock assembly described herein may be manufactured from a variety of materials having sufficient strength to resist tampering with a variety of common household tools. For example, components having exposed surfaces such as the muzzle insert, locking rod, or chamber insert may be hardened by heat or chemical treatments. Additionally, the surfaces of the components in contact with the external portions of the firearm barrel and muzzle may be provided with protective layers of cushion material, such a rubber, to prevent scratching or damage to the firearm barrel and muzzle. For example, a rubber 0-ring may be insert within the face of the muzzle insert seating against the outer face of the firearm muzzle, preventing metal-to-metal contact.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A firearm safety lock assembly for use with a firearm having a barrel disposed between a breech and a muzzle, comprising:

a flexible member having opposed first and second ends;

a chamber insert sized to fit within a breech of a firearm, said chamber insert having a longitudinal axis, and said first end of said flexible member secured to said chamber insert on said longitudinal axis;

a rigid locking rod fixed at said second end of said flexible member, said rigid locking rod including at least one circumferential groove;

a muzzle insert including a first portion sized to seat within a firearm muzzle opposite said chamber insert, a second portion sized to extend beyond said open end of said firearm muzzle, said second portion having an external diameter greater than an internal diameter of said muzzle and said muzzle insert second portion having a first circumferential flange and a second circumferential flange, said first circumferential flange and said second circumferential flange defining a circumferential channel, a axial bore through said first portion and said second portion, said axial bore configured to receive said rigid locking rod; and at least one lock element configured to removably engage said at least one circumferential groove of said rigid locking rod within said axial bore, securing said rigid locking rod in swiveling engagement with said muzzle insert such that said flexible member is secured through the firearm barrel between said chamber insert and said muzzle insert.

2. The firearm safety lock assembly of claim 1 further including:

at least one bore disposed within said muzzle insert second portion, said at least one bore linking said axial bore and said circumferential channel;

said at least one lock element disposed within each of said at least one bore, said at least one lock element displaceable between a locked position partially disposed within said axial bore and an unlocked position partially disposed within said circumferential channel;

wherein said circumferential channel is configured to seat a lock armature to displace said at least one lock element from said unlocked position to said locked position; and wherein said at least one lock element is configured to engage said at least one circumferential groove of said rigid locking rod within said axial bore in said locked position, securing said rigid locking rod in swiveling engagement with said muzzle insert such that said cable is secured through the firearm barrel between said chamber insert and said muzzle insert.

3. The firearm safety lock assembly of claim 1 wherein said muzzle insert second portion includes a receiver fixed to said muzzle insert first portion and a removable shackle matched to said receiver, said removable shackle and said receiver longitudinally bisecting a portion of said axial bore; and wherein said circumferential channel is configured to seat a removable lock armature to secure said removable shackle to said receiver in a locked configuration.

4. The firearm safety lock assembly of claim 3 wherein said at least one lock element comprises a reduced diameter portion of said axial bore formed in said removable shackle.

5. The firearm safety lock assembly of claim 4 wherein said at least one lock element further comprises a second reduced diameter portion of said axial bore formed in said receiver, radially opposite said reduced diameter portion formed in said removable shackle in said locked configuration.

6. A firearm safety lock assembly for use with a firearm having a barrel disposed between a breech and a muzzle, comprising:

a cable having opposed first and second ends;

a chamber insert sized to fit within a breech of a firearm, said chamber insert having a longitudinal axis, and said first end of said cable secured to said chamber insert on said longitudinal axis;

a rigid locking rod including at least one circumferential groove fixed at said second end of said cable;

a muzzle insert having a cylindrical body sized to partially seat within a firearm muzzle opposite said chamber insert, said muzzle insert including an axial bore configured to receive said rigid locking rod;

a first circumferential flange on said cylindrical body with an external diameter greater than an internal diameter of said firearm muzzle, and a second circumferential flange spaced from said first circumferential flange on said cylindrical body with an external diameter greater than an internal diameter of said firearm muzzle, said first and second circumferential flanges defining a circumferential channel there between;

at least one bore disposed within said cylindrical body, said at least one bore linking said axial bore and said circumferential channel;

a displaceable lock pin disposed within each of said at least one bore, said lock pin displaceable between a locked position partially disposed within said axial bore and an unlocked position partially disposed within said circumferential channel;

wherein said circumferential channel is configured to seat a lock element armature to displace said lock pin from said unlocked position to said locked position; and wherein said displaceable lock pin is configured to engage said at least one circumferential groove of said rigid locking rod within said axial bore in said locked position, securing said rigid locking rod in swiveling engagement with said muzzle insert such that said cable is secured through the firearm barrel between said chamber insert and said muzzle insert.

7. The firearm safety lock assembly of claim 6 wherein said at least one bore is a radial bore.

8. The firearm safety lock assembly of claim 6 wherein said first end of said cable is secured by a swivel to said chamber insert.

9. A method for utilizing a firearm safety lock including a flexible tension member having opposed first and second ends, a chamber insert sized to fit within a breech of a firearm secured to said first end of said tension member by a swivel; a locking rod including at least one circumferential groove secured to said second end of said flexible tension member; a muzzle insert having a first portion sized to seat within a muzzle of a firearm barrel opposite said chamber insert, a second portion sized to extend beyond said firearm muzzle, said second portion having an external diameter greater than an internal diameter of said firearm muzzle, said muzzle insert further including an axial bore, and at least one lock element disposable within said axial bore; comprising:

inserting said locking rod and said flexible tension member into said firearm barrel though said firearm breech;

seating said chamber insert within said firearm breech;

drawing said flexible tension member through said firearm barrel such that a portion of said locking rod protrudes beyond said firearm muzzle;

passing said protruding portion of said locking rod through said axial bore of said muzzle insert, such that said first portion of said muzzle insert seats within said firearm muzzle;

exerting force on said rigid cylindrical locking rod to draw said flexible tension member through said firearm barrel and said seated firearm muzzle insert, such that said at least one circumferential groove in said locking rod is disposed within said second portion of said muzzle insert; and securing said lock element within said axial bore to engage said circumferential groove, thereby securing said flexible tension member in swivel engagement between said chamber insert and said muzzle insert.

10. A lock assembly for use with a firearm safety locking kit having a chamber insert sized to fit within a breech of a firearm, a first end of a flexible member secured to said chamber insert on a longitudinal axis and extending through a barrel of the firearm, comprising:

a rigid locking rod, said rigid locking rod including at least one circumferential groove;

an insert including:

a first circumferential flange and a second circumferential flange, said first circumferential flange and said second circumferential flange defining a circumferential channel, and an axial bore, said axial bore configured to receive said rigid locking rod; and at least one lock element configured to removably engage said at least one circumferential groove of said rigid locking rod within said axial bore, securing said rigid locking rod in swiveling engagement with said insert.

11. The lock assembly of claim 10 for use with a firearm safety locking kit, further including:

at least one bore disposed within said insert, said at least one bore linking said axial bore and said circumferential channel;

said at least one lock element disposed within each of said at least one bore, said at least one lock element displaceable between a locked position partially disposed within said axial bore and an unlocked position partially disposed within said circumferential channel;

wherein said circumferential channel is configured to seat a lock armature to displace said at least one lock element from said unlocked position to said locked position; and wherein said at least one lock element is configured to engage said at least one circumferential groove of said rigid locking rod within said axial bore in said locked position, securing said rigid locking rod in swiveling engagement with said insert.

12. The lock assembly of claim 10 for use with a firearm safety locking kit, wherein said insert includes a receiver and a removable shackle matched to said receiver, said removable shackle and said receiver longitudinally bisecting a portion of said axial bore; and wherein said circumferential channel is configured to seat a removable lock armature to secure said removable shackle to said receiver in a locked configuration.

13. The lock assembly of claim 12 for use with a firearm safety locking kit, wherein said at least one lock element comprises a reduced diameter portion of said axial bore formed in said removable shackle.

14. The lock assembly of claim 13 wherein said at least one lock element further comprises a second reduced diameter portion of said axial bore formed in said receiver, radially opposite said reduced diameter portion formed in said removable shackle in said locked configuration.

* * * * *